United States Patent [19]

Young

[11] Patent Number: 4,836,289

[45] Date of Patent: Jun. 6, 1989

[54] METHOD AND APPARATUS FOR PERFORMING WIRELINE OPERATIONS IN A WELL

[75] Inventor: Joe A. Young, Lafayette, La.

[73] Assignee: Southland Rentals, Inc., Houma, La.

[21] Appl. No.: 155,063

[22] Filed: Feb. 11, 1988

[51] Int. Cl.[4] ..... E21B 33/072

[52] U.S. Cl. ..... 166/379; 166/80; 166/85; 166/86; 166/385

[58] Field of Search ..... 166/75.1, 76, 80, 82, 166/83, 86, 85, 381, 378, 382, 379, 385; 285/138, 140, 142; 175/214, 209, 215; 411/513, 515

[56] References Cited

U.S. PATENT DOCUMENTS

| | | | |
|---|---|---|---|
| 1,400,962 | 12/1921 | Leonard | 166/86 |
| 1,529,580 | 3/1925 | Douglas | 411/513 |
| 3,071,190 | 1/1963 | Ehlert | 166/85 |
| 3,100,015 | 8/1963 | Regan | 166/86 |
| 4,090,573 | 5/1978 | Rankin | 175/214 X |
| 4,307,783 | 12/1981 | Lanmon, II | 166/385 X |
| 4,553,591 | 11/1985 | Mitchell | 166/86 X |

*Primary Examiner*—Bruce M. Kisliuk

*Attorney, Agent, or Firm*—Bill B. Berryhill

[57] ABSTRACT

Method and apparatus for performing operations in a well near the surface of which is a blowout preventer stack. The apparatus includes a bell nipple assembly extending upwardly from the blowout preventer stack and a lubricator assembly for central disposition within the bell nipple assembly. The bell nipple assembly includes a flange member for attachment to the blowout preventer stack having locking pins radially movable between retracted positions and extended positions in which the pins penetrate the flange bore. The lubricator assembly includes a tubular mandrel which may be lowered and locked in the bore of the bell nipple flange member in nonsealing engagement therewith by the locking pins thereof. At least one flow passage through the body of the mandrel assures that no pressure seal is established in the annular spaces between the bell nipple assembly and the lubricating assembly.

22 Claims, 3 Drawing Sheets

METHOD AND APPARATUS FOR PERFORMING WIRELINE OPERATIONS IN A WELL

BACKGROUND OF THE INVENTION

1. Field of the Invention

The present invention pertains to oil and/or gas well operations. More specifically, it pertains to methods and apparatus used in performing wireline operations during the drilling, completion or workover of an oil and/or gas well.

2. Brief Description of the Prior Art

In conventional drilling operations, drilling proceeds through well hole or casing at the upper end of which is provided, near the surface of the well, a wellhead. Surmounted on the wellhead is a blowout preventer stack which usually includes an upper annular blowout preventer and one or more ram-type blowout preventers. Surmounted on the blowout preventer stack is a bell nipple assembly which terminates somewhere just beneath the rotary drilling table and the floor or platform of the drilling rig.

A string of drill pipe usually extends downwardly through the rotary drilling table, the bell nipple assembly, the blowout preventer stack and the wellhead down into the well. Drilling proceeds by rotating the drill string and the drill bit attached to the lower end thereof. Drilling fluids are usually introduced into the well through the drill string to control pressures in the well. However, in the event that pressure in the well should become excessive, the blowout preventers of the blowout preventer stack may be actuated to seal off the well to control these excessive well pressures. For example, the annular blowout preventer may be closed around the drill string to seal off the annulus between the drill string and the surrounding casing or hole.

At certain times during drilling, particularly during completion of the well or in workover operations, pipe string is removed and various types of wireline tools are lowered into the well suspended from a wireline or cable. This usually requires installation of a wireline lubricator assembly. The wireline lubricator is a device used, in conjunction with the drilling rig blowout preventers, to control pressure that may be encountered while performing various wireline services in cased or open hole operations. The lubricator assembly should be of sufficient size and length to totally contain the entire length and circumference of the wireline tool or tools being used. If well pressure is encountered while wireline operations are being performed, the wireline tools can be pulled up into the lubricator. Once the wireline tools are inside the lubricator, the blind rams of the ram-type blowout preventers are closed. The wireline tools and equipment can then be safely removed, the well pressure being contained below the blind rams.

The wireline lubricator assembly generally provides a tubular member which extends from somewhere near the blowout preventer stack upwardly through the rotary table and at the upper end of which is provided a wireline packoff assembly. The wireline tools are lowered through the lubricator assembly and a wireline pack-off assembly actuated or installed around the wireline to assist in controlling pressure in the well.

With one type of wireline lubricator, which may be referred to as the "flange-type", it is necessary to remove the bell nipple assembly. This requires unbolting of many bolts from the flange connection between the bell nipple assembly and the blowout preventer stack and the connection between the flowline and the bell nipple assembly. Then the bell nipple assembly is removed and the flange-type lubricator surmounted on the blowout preventer stack and bolted thereto. This bolted connection must be able to hold well pressure and requires testing for this purpose. After wireline operations are completed, then the flange-type lubricator assembly must be unbolted and removed and the bell nipple assembly reattached to the blowout preventer stack. Then the flowline must be reattached to the bell nipple assembly. While this type of lubricator assembly is relative safe, its use is very time consuming. The changing out of the bell nipple assembly and installation of the flange-type lubricator assembly may require several hours of rig time. Rig time is, of course, extremely expensive.

In an attempt to save rig time, a wireline lubricator of the "chained down" type has sometimes been used. This type of wireline lubricator does not require the removal of the bell nipple. In the chained down wireline lubricator, the tubular extension thereof is simply lowered through the rotary table and the bell nipple assembly. As this is initially done, the ram-type blowout preventer of the blowout preventer stack is closed while the annular blowout preventers remain open. The wireline lubricator is lowered until it makes contact with the blind rams of the ram-type blowout preventer. Then the wireline lubricator is picked up one or two feet above the rams and slips are set around the lubricator at the rotary table. Then chains are tied around the wireline lubricator above the rotary table and the chains are fastened to the rotary table or the rig floor. Thus, the only thing which prevents this type of wireline lubricator from being blown out of the well by excessive well pressures is the chains by which it is tied. While the chained down type wireline lubricator is relatively fast to install, it is far from safe. Few drilling companies are using the chained down type lubricator because of the hazards involved in its use.

In U.S. Pat. No. 4,553,591, apparatus is disclosed which eliminates the need to remove the bell nipple assembly for wireline operations. This apparatus includes a spool member which is installed between the blowout preventer stack and the bell nipple assembly. The spool may receive the mandrel of a test assembly for testing the seals of the blowout preventers or it may receive another mandrel of a lubricator assembly for wireline operations. In either case, the mandrels are seated within the spool member and peripherally sealed in the spool. They are retained in place by threaded radial pins. While this apparatus offers advantages over some of the prior art, it too has problems. For one thing, the number of pressure containing points is substantially increased. The spool requires a seal at its lower flange with the blowout preventers. In addition, there is at least one set of lock screws which must hold pressure. Pressure integrity is, of course, very important in drilling, completion and workover operations.

While the prior art has provided a number of ways of installing a lubricator assembly for wireline operations, the prior art designs are not totally satisfactory. Thus, the improvement for wireline operations continues.

SUMMARY OF THE PRESENT INVENTION

In the present invention, apparatus is provided which permits a wireline lubricator assembly to be installed and held in place without removal of the bell nipple assembly. In fact, the flange member of the bell nipple assembly is adapted to cooperate with the wireline lubricator assembly so that the wireline lubricator assembly can be lowered through the rotary drilling table and the bell nipple assembly for support and locking in place within the bell nipple assembly. There is no necessity for disconnecting the bell nipple assembly or the flowline connected thereto. Once wireline operations are completed, the wireline lubricator assembly may be easily removed again without disturbing the connections of the bell nipple assembly. Normal drilling or workover operations can then continue.

In the present invention, the central bore of a modified bell nipple assembly flange is provided with an upwardly facing annular support shoulder and a plurality of radially disposed pin members disposed in the flange member for radial movement between first positions not penetrating the central bore thereof and second positions penetrating into the central bore.

The apparatus also includes a wireline lubricator assembly which includes a centrally bored tubular mandrel, the exterior of which is provided with a downwardly facing annular support surface engageable with the upwardly facing shoulder of the bell nipple flange member to support the lubricator assembly. A lower tubular extension is attached to the mandrel for extension into the blowout preventer stack and an upper tubular extension is attached to the mandrel for extending upwardly through the bell nipple assembly for connection with a wireline lubricator pack-off assembly. The tubular mandrel of the wireline lubricator assembly has a locking shoulder provided on the exterior thereof which is engageable with the radially disposed pin members of the bell nipple flange member, upon movement to their second positions, to lock the wireline lubricator assembly within the bell nipple assembly.

Thus, the method and apparatus of the present invention provides a bell nipple assembly for normal drilling operations which does not have to be removed during wireline operations. It also provides a wireline lubricator assembly which may be lowered through the bell nipple assembly for support by its flange member. An important feature of the mandrel of the wireline lubricating assembly is the provision of at least one longitudinal passageway through the body of the mandrel to establish fluid communication between annular spaces surrounding the upper and lower tubular extensions of the lubricator assembly. Thus, the mandrel does not have to maintain a seal within the bell nipple flange. In fact, there is no seal between the annular spaces surrounding the lubricator assembly. Well control does not have to rely on such a seal. Well control is effected through the blowout preventers and the pack-off assembly at the upper end of the wireline lubricator assembly. Many other objects and advantages of the invention will be understood from reading the specification which follows in conjunction with the accompanying drawings.

DESCRIPTION OF A PREFERRED EMBODIMENT

Figure 1:
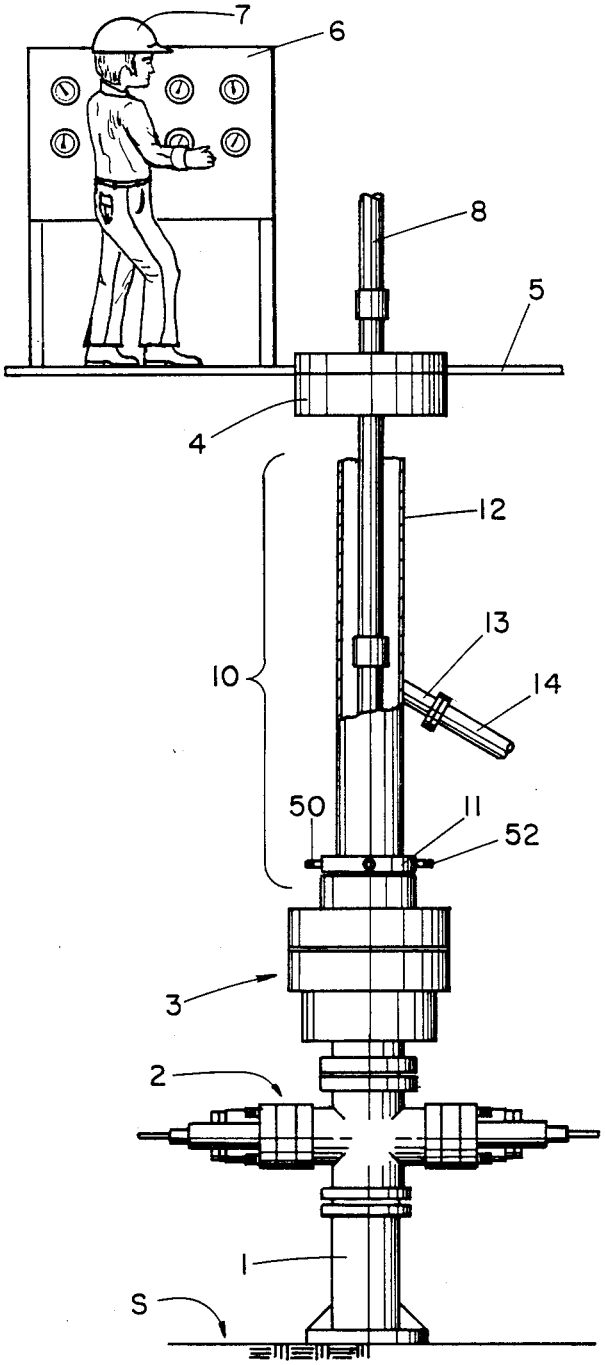
FIG. 1 is an elevation view, partially in section, of the upper portion of a well and drilling rig from which the well is being drilled, including a blowout preventer stack and a bell nipple assembly having a specially modified flange member, according to a preferred embodiment of the invention.

Referring first to FIG. 1, there is shown a wellhead 1 installed at the surface S of the ground in which a well is being drilled. Surmounted on the wellhead 1 is a blowout preventer stack which, in exemplary embodiment, includes a ram-type blowout preventer 2 and an annular blowout preventer 3. Most blowout preventer stacks include one annular blowout preventer and one or more ram blowout preventers. Surmounted on the blowout preventer stack and extending upwardly therefrom is a bell nipple assembly 10 which includes an annular flange member 11, by which the bell nipple assembly 10 is attached to annular blowout preventer 3, and a tubular member 12 which terminates underneath the rotary drilling table 4 of a drilling rig the floor or platform of which is referenced at 5. Observing and operating controls 6 on the drilling platform 5 is a driller 7. A string of drill pipe 8 extends downwardly through the rotary table 4, bell nipple assembly 10, the blowout preventer stack 3, 2 and the wellhead 1 into the casing or hole (not shown) of the well. Normally a drilling bit (not shown) is attached to the lower end of the drill string 8 and the drill string is rotated by the rotary table 4 to provide the rotation necessary for cutting action of drilling bit.

Normally, drilling fluids are introduced into the drill string 8 and circulate through the drill bit for upward return through the annular space surrounding the drill string 8. These drilling fluids cool the drill bit and carry drill cuttings and other materials upwardly through this annular space for exit through a flowline connection 13 of the bell nipple assembly 10. The flowline connection 13 is connected to a flowline 14 which runs to a mud pit or the like. Not only do the drilling fluids cool the drill bit and return cuttings, they maintain pressure control on the well. However, in the event well pressures should become excessive, the blowout preventers 2 and 3 may be actuated to close around the drill string 8 and seal the excessive pressure there below. In some cases a blind ram-type blowout preventer is provided which totally closes the well when the drill string 8 has been removed therefrom.

On certain occasions it has been desirable to utilize wireline tools in the drilling of a well. Wireline tools are normally lowered into the well on a wireline or cable. When this is done, it is necessary to remove the drill string 8 and install a wireline lubricator assembly such as generally referenced at 20 in FIG. 2. The wireline lubricator assembly 20 includes a centrally bored tubular mandrel 21, a lower tubular extension 22 and an upper tubular extension 23. Another joint or tubular extension 24 cut to the desired length may be attached to upper tubular extension 23 by a threaded collar 25 so that the wireline lubricator assembly extends upwardly through the rotary drilling table 4 for receiving a wireline pack-off assembly 26. After the wireline lubricator assembly 20 is in place, wireline tools may be placed therein on the lower end of a cable or wireline 27 and the wireline pack-off assembly installed or activated.

Figure 3:
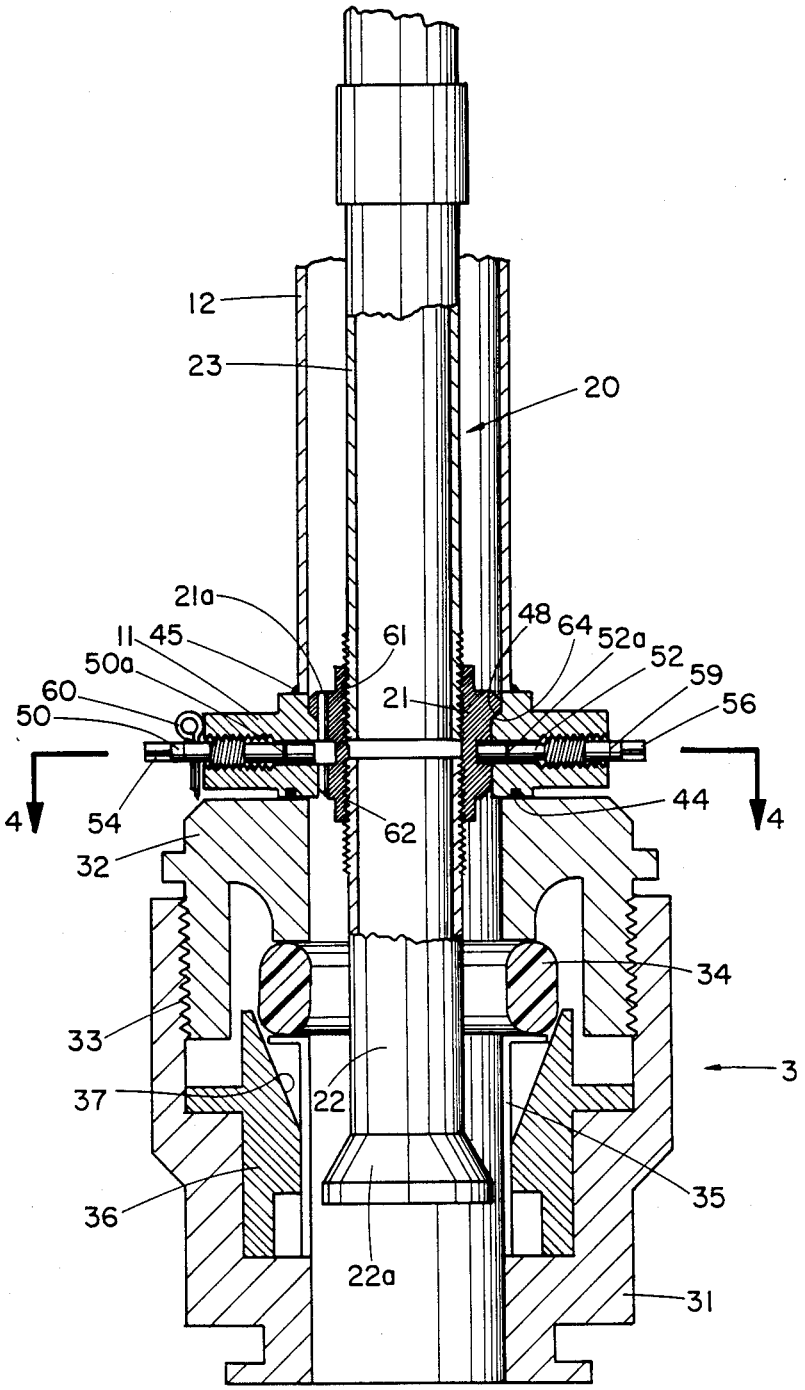
FIG. 3 is an enlarged elevation view of the apparatus in FIG. 2 showing a portion of the apparatus in section and in greater detail.

Referring now also to FIGS. 3, 4, 5 and 6, some of these components will be described in much greater detail. While they do not form a part of the apparatus of the present invention, it is necessary to understand operation of the annular blowout preventer 3. As shown in FIG. 3, the annular blowout preventer 3 is shown as having a body with lower and upper body portions 31 and 32 threadedly connected at 33. Supported within the body of the annular blowout preventer 3 is an annular seal 34 and a cylindrical sleeve 35. Carried within an annular cavity of the body is an annular piston 36 which is mounted for reciprocal movement therein under the influence of hydraulic pressure. The exact details of this operation is not necessary for understanding the present invention. It is sufficient to understand that movement of the annular piston 36 in an upwardly direction will, through the engagement of an inclined surface 37 with the annular seal 34, cause the annular seal 34 to contract and sealingly engage any cylindrical member extending therethrough. In FIG. 3, such cylindrical member is the lower tubular extension 22 of the wireline lubricator assembly 20.

Figure 4:
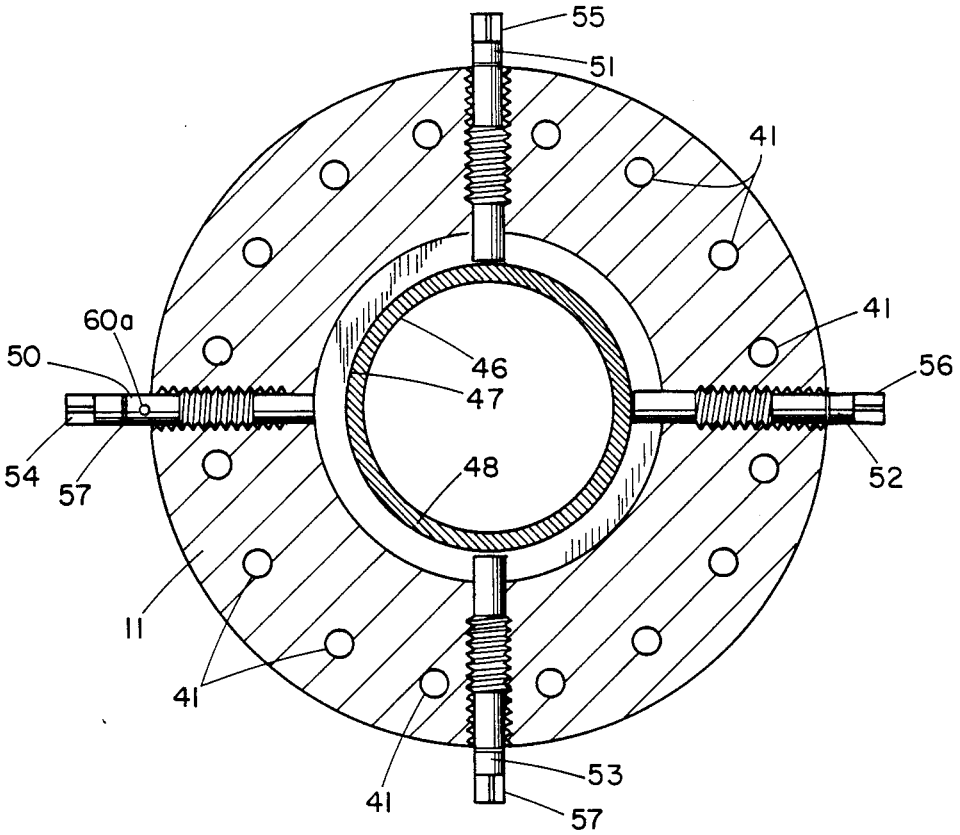
FIG. 4 is a sectional view of the apparatus of FIG. 3 taken along lines 4—4 thereof.

As previously mentioned, the bell nipple assembly of FIG. 1 is surmounted on the blowout preventer 3 by connection of the bell nipple flange member 11. As also seen in FIG. 4, the bell nipple flange member 11 is provided with a plurality of hole 41 through which bolts or studs extend for connection with corresponding threaded hole in annular blowout preventer 3. A ring type seal 44 may be provided at this junction to assure a fluidtight seal. The tubular member 12 of the bell nipple assembly may be welded as at 45 or attached to the flange member 11 in any other suitable manner. The length of the bell nipple tubular member 12 depends on the distance to the drilling platform of each particular rig.

Of course, the flange member 11 has a central bore 46 which provides fluid communication between the blowout preventer 3 and the tubular member 12. The bore 46 has a counterbore 47 and an inclined upwardly facing annular support shoulder 48. The flange member is radially drilled and tapped to provide threaded radial holes which is disposed a plurality of lock down pin members 50, 51, 52 and 53. These pin members are radially moveable between first positions (see pin member 50) not penetrating the bore of the flange 11 and second positions (pins 51, 52, 53) penetrating into the central bore. The outer ends of the pins 50, 51, 52, 53 are provided with wrench flats 54, 55, 56 and 57 engageable externally of the flange member 11 for rotation thereof to effect radial movement of the pin members between the first and second positions. Each of the pin members is also provided with indicia, 57 for pin member 50, 59 for pin member 52, visible from the outer periphery of the flange member 11 and by which it can be determined when the pin members are fully extended into the bore 46. Each of the pin members may also be provided, at a specified distance from the inner ends thereof, with a transverse hole throughwhich a safety pin, such as shown at 60 with pin 50, may project preventing the pin members from being moved to their second or penetrating positions.

Figure 5:
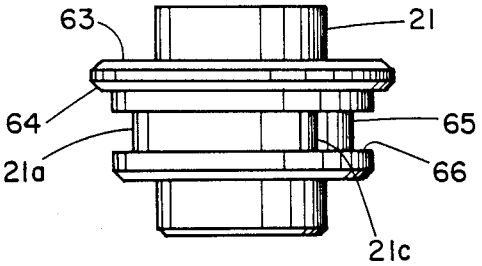
FIG. 5 is an elevation view of the lubricator assembly mandrel shown in FIGS. 3 and 4 with all other components removed therefrom.
Figure 6:
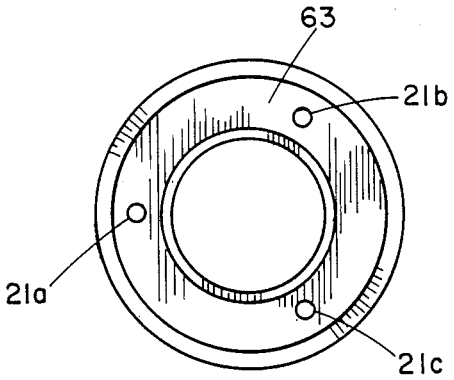
FIG. 6 is a top view of the mandrel of FIG. 5.

As best seen in FIGS. 3, 5 and 6, the wireline lubricator assembly mandrel 21 is centrally bored and threaded at 61 and 62 for threaded connection to the lower tubular extension 22 and the upper tubular extension 23, respectively. The exterior of the mandrel 21 has an annular flange portion 63 which is provided with an inclined and downwardly facing annular support surface 64 engageable with the upwardly facing shoulder 48 of the bell nipple flange 11 to support the lubricator assembly 20 in the positions shown in FIGS. 2 and 3. The exterior of the mandrel 21 has an annular groove or recess 65 which provides a locking shoulder 66 which when engaged by the inner ends of the locking pins 50, 51, 52, 53 locks the wireline lubricator assembly within the bell nipple assembly 10. O-ring seals 50*a*, 52*a*, etc. prevent leakage.

Figure 2:
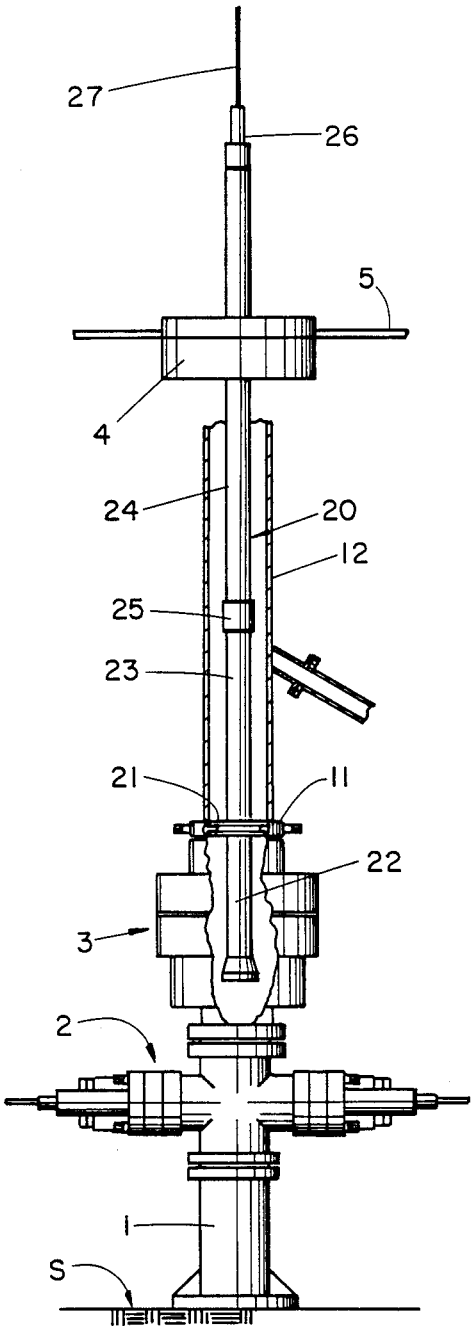
FIG. 2 is an elevation view similar to the one shown in FIG. 1, but showing the drill string removed therefrom and a wireline lubricator assembly installed, according to a preferred embodiment of the invention.

It will be noted that the lower tubular extension 22 of the wireline lubricator assembly, when installed as in FIGS. 2 and 3, projects through the annular blowout preventer 3 to prevent damage to the annular blowout preventer and particularly the annular seal 34 thereof from wirelines or wireline tools passing therethrough. It will also be noted that the lower end of the tubular extension 22 is provided with an enlarged centralizing portion 22*a* the external diameter of which is greater than the external diameter of the tubular extension 22 but less than the internal diameter of the bore of the bell nipple flange member 11. This aids in centering of the wireline lubricator assembly as it is being lowered into place.

Of course, fluid communication is established between the interiors of the upper and lower tubular extensions 23 and 24 through the bore of the mandrel 21. The mandrel 21 is also provided with at least one longitudinal passageway 21*a*, 21*b*, 21*c* through the body thereof to establish fluid communication between annular spaces surrounding the upper and lower tubular extensions 23 and 22. This is a very important feature. Note that there is no seal between the mandrel 21 and the bore of the flange member 11. The passageways 21*a*, 21*b*, 21*c* further assure this condition. Thus, the lubricator assembly would not be subjected to large upwardly directed forces due to any pressures in the well, reducing the danger of the wireline lubricator assembly and wireline tools being blown out of the well. This is certainly not the case in much of the prior art. The axes of passageways 21*a*, 21*b*, 21*c* are disposed at angular displacements, relative to the axis of the mandrel 21, different than that between adjacent ones of the pin members 50, 51, 52, 53 of the bell nipple flange 11. For example in the exemplary embodiment, the pin members are separated by angles of ninety degrees and the passageways 21*a*, 21*b*, 21*c* by one hundred twenty degrees. This assures that if one of the pin members were in registration with one of the passageways 21*a*, 21*b*, 21*c*, possibly blocking fluid flow therethrough, none of the others would be so aligned.

The installation and method of use of the present invention will now be reviewed. The bell nipple assembly 10 and its specially modified bell nipple flange 11 are, of course, installed as the drilling rig is initially set up. The lock down pins 50, 51, 52, 53 are placed in there first or retracted positions so that they do not penetrate the bore of the flange member 11. They are preferably maintained in this position by inserting safety pins, such as safety pin 60 shown in FIG. 3. These positions are maintained while normal drilling proceeds with the drill string 8.

When it is desired to perform wireline operations, the drill string 8 is removed and the wireline lubricating assembly 20 is lowered into the bell nipple assembly 10 until the mandrel 21 thereof rests within the bore 46 of the bell nipple flange 11. Movement is arrested by engagement of the mandrel shoulder 64 with the flange member shoulder 48. Once movement of the wireline lubricator assembly 20 is arrested by engagement of the mandrel 21 and flange member 11, the safety pins 60 are removed from the locking pins 50, 51, 52, 53 and these pins are rotated, through their threaded connections, until the inner ends thereof penetrate the flange member bore engaging the annular recess 65 of the mandrel member 21 and the upwardly facing locking shoulder 66 provided thereby. The indicia 57, 59, etc. provide visual indication when the pins are in their fully extended second or locked positions.

Next the wireline tools are lowered into the wireline assembly and the wireline pack-off assembly 26 is placed in proper position. At this point, if desired, the wireline lubricator assembly and the blowout preventer stack can be tested by closing the ram-type blowout preventer 2 below the wireline assembly 20 and the annular blowout preventer 3 therearound while introducing pressure into the lubricator assembly. This will disclose whether or not there are any leaks in the lubricator assembly or the blowout preventers.

After the lubricator assembly 20 is locked or anchored in place, and the blowout preventers opened, the wireline tools (not shown) may be lowered into the well for the operations to be performed therewith. Should excessive well pressures be encountered while wireline operations are being performed, the wireline tools may be pulled up into the lubricator assembly 20. Once the tools are completely inside the lubricator assembly 20, the ram-type blowout preventers 2 may be closed, isolating the wireline tools from well pressure.

Of course, as soon as wireline operations are completed, the wireline tools may also be pulled up into the wireline lubricator assembly 20 and the ram-type blowout preventers closed to allow removal of the wireline tools and the wireline lubricator assembly 20. The wireline lubricator assembly 20 is easily removed simply by rotating the locking pins 50, 51, 52, 53 from their fully extended or locked second positions to their retracted or first positions allowing release of the mandrel 21 and all of the components of the lubricating assembly. Normal drilling can then proceed by lowering the drill string 8 back into the well through the bell nipple assembly 10. It is important to note that the bell nipple assembly 10 remains in place from the beginning of drilling operations to the end and does not require removal for installation of the wireline lubricating assembly 20.

The annular blowout preventer 3 of the blowout preventer stack remains open at all times during wireline operations with the present invention, except for testing of the lubricator assembly 20 or upon encountering excessive well pressures. The open blowout preventer 3, in conjunction with the passageways **21*a*, 21*b* and 21*c*, allow fluid flow from wireline tool displacement and from the well to be monitored, as usual, by flow through the bell nipple assembly 10 and flowline 14**.

Thus, the apparatus of the present invention provides apparatus for performing wireline operations in a well without removal of the bell nipple assembly and by simply lowering the apparatus into place and locking into place with minor work. Not only is the apparatus and its method of use extremely safe, it can be installed in much less time than wireline equipment of the prior art saving as much as six to eight hours or rig time. This results in substantially reduced drilling costs.

The apparatus of the invention is extremely simple in construction requiring only a modified bell nipple flange member and three components of a wireline lubricator assembly, i.e., a tubular mandrel and upper and lower tubular extensions attached thereto. The safety and quick installation of the apparatus of the present invention is unique to the industry.

While the present invention has been described in drilling operations, it may be utilized for any drilling, completion or workover operation in which wireline tools are needed. Furthermore, the apparatus of the present invention might be utilized in operations other than wireline operations. Although the invention has been described for wireline operations, it is not intended to be limited to such. A single preferred embodiment of the invention has been described herein. However, many variations can be made without departing from the spirit of the invention. Accordingly, it is intended that the scope of the invention be limited only by the claims which follow.

I claim:

1. Apparatus for performing wireline operations in a well near the surface of which is a blowout preventer stack, said apparatus comprising:

a bell nipple assembly extending upwardly from said blowout preventer stack including an annular flange member by which said bell nipple assembly is attached to said blowout preventer stack and a tubular member extending upwardly from said flange member, said flange member having a central bore therein through which fluid communication may be established between said blowout preventer stack and said tubular member, said bore being provided with an upwardly facing annular support shoulder; and a wireline lubricator assembly for central disposition within said bell nipple assembly including a centrally bore tubular mandrel the exterior of which is provided with a downwardly facing annular support surface engageable with said upwardly facing shoulder of said bell nipple flange member to support said lubricator assembly, a lower tubular extension attached to said mandrel and extending into said blowout preventer stack and an upper tubular extension attached to said mandrel and extending upwardly through said bell nipple tubular member for connection with a wireline lubricator, fluid communication being established between the interiors of said upper and lower tubular extensions through the bore of said mandrel, said mandrel also being provided with at least one passageway through the body thereof to establish fluid communication between annular spaces surrounding said upper and lower tubular extensions, said lubricator assembly being capable of receiving wireline tools for lowering into said well.

2. The apparatus of claim 1 in which said bell nipple flange member is provided with a plurality of radially disposed pin members radially movable between first positions not penetrating said flange member central bore and second positions penetrating into said flange member central bore for engagement with a locking shoulder provided on the exterior of said mandrel to lock said wireline lubricator assembly within said bell nipple assembly.

3. The apparatus of claim 2 in which said pin members threadedly engage threaded radial holes provided in said bell nipple flange member, the outer ends of said pin members being engageable externally of said flange member for rotation thereof to effect said radial movement of said pin members between said first and second positions.

4. The apparatus of claim 3 in which said pin members are provided with indicia visible from the outer periphery of said flange member and by which it can be determined when said pin members are fully extended for engagement with said mandrel locking shoulder.

5. The apparatus of claim 3 in which said pin members are provided, at a specified distance from the inner ends thereof, with a transverse hole through which a safety pin may project preventing said pin members from being moved to positions penetrating said flange member central bore.

6. The apparatus of claim 2 in which said mandrel locking shoulder is provided by an annular groove provided on the periphery of said mandrel.

7. The apparatus of claim 1 including at least two of said passageways the angular displacement of the axes of which, as viewed in cross-section relative to the axis of said mandrel, is different than the angular displacement between adjacent ones of said pin members so that if one of said passageways were in registration with one of said pin members the other of said passageways would not be in registration with any of said pin members.

8. Apparatus for performing wireline operations in a well near the surface of which is a blowout preventer stack which includes an annular blowout preventer, said apparatus comprising:

a bell nipple assembly extending upwardly from said blowout preventer stack including an annular flange member by which said bell nipple assembly is attached to said blowout preventer stack and a tubular member extending upwardly from said flange member, said flange member having a central bore therein through which fluid communication may be established between said blowout preventer stack and said tubular member, said bore being provided with an upwardly facing annular support shoulder; and a wireline lubricator assembly for central disposition within said bell nipple assembly including a centrally bored tubular mandrel the exterior of which is provided with a downwardly facing annular support surface engageable with said upwardly facing shoulder of said bell nipple flange member to support said lubricator assembly, a lower tubular extension attached to said mandrel and extending into said blowout preventer stack and an upper tubular extension attached to said mandrel and extending upwardly through said bell nipple tubular member for connection with a wireline lubricator, said lubricator assembly being capable of receiving wireline tools for lowering into said well, said lower tubular extension projecting through said annular blowout preventor when said lubricator assembly is supported by said bell nipple flange member shoulder, to prevent damage to said annular blowout preventer from wireline and wireline tools.

9. The apparatus of claim 8 in which the lower end of said lower tubular extension is provided with a centralizing portion the external diameter of which is greater than the external diameter of said lower tubular extension and less than the internal diameter of the bore of said bell nipple flange member.

10. The apparatus of claim 9 in which the exterior of said centralizing member flares downwardly and outwardly from said lower end of said lower tubular extension.

11. The apparatus of claim 8 in which the exterior of said lower tubular extension is sealingly engageable by said annular blowout preventer, on actuation of said annular blowout preventer, isolating the exterior of said mandrel and the annular space between said lubricator assembly and said bell nipple assembly from the fluid pressures within said well but permitting said fluid pressures to be communicated to the interior of said lubricating assembly.

12. A method of performing wireline operations during drilling of a well at the surface of which is provided a blowout preventer stack on which is surmounted a bell nipple assembly having a centrally bore flanged at the lower end thereof, said bell nipple flange having a plurality of locking pins which are engageable externally of said bell nipple flange for radial movement between retracted positions not penetrating the bore of said bell nipple flange to extended positions penetrating said bore, said method comprising the steps of:

removing any drill pipe from said well through said bell nipple assembly while said pin members are in said retracted positions;

lowering a wireline lubricating assembly, having a wireline pack-off assembly below which are upper and lower tubular extensions coupled by a tubular mandrel, through said bell nipple assembly until downward movement of said mandrel is arrested by a stop shoulder in said bell nipple flange;

activating said locking pins by movement to said extended positions where they engage a locking shoulder of said mandrel locking said wireline lubricating assembly in place;

lowering wireline tools into said well through said wireline lubricating assembly and performing wireline operations therein; and maintaining fluid communication between the annular areas surrounding said upper and lower tubular extensions by providing at least one flow passage through the body of said mandrel.

13. The method of performing wireline operations as set forth in claim 12 in which the blowout preventers of said blowout preventer stack are closed prior to lowering of said wireline tools into said well and pressure is applied through said wireline lubricating assembly to pressure test said pack-off assembly and other components of said lubricating assembly and said blowout preventers.

14. The method of performing wireline operations as set forth in claim 12 including the additional steps of:

removing said wireline tools from said well;

returning said locking pins to said retracted positions to unlock said mandrel;

removing said wireline lubricating assembly from said well through said bell nipple assembly; and continuing drilling operations through said bell nipple assembly.

15. The method of performing wireline operations as set forth in claim 12 in which said blowout preventer stack includes an annular blowout preventer through which said lower tubular extension extends to protect said annular blowout preventer from said wireline tools and the wireline to which they are attached.

16. Apparatus for performing operations in a well near the surface of which is a blowout preventer stack, said apparatus comprising:

a bell nipple assembly extending upwardly from said blowout preventer stack including an annular flange member by which said bell nipple assembly is attached to said blowout preventer stack and a tubular member extending upwardly from said flange member, said flange member having a central bore therein through which fluid communication may be established between said blowout preventer stack and said tubular member, said bore being provided with an upwardly facing annular support shoulder; and a lubricator assembly for central disposition within said bell nipple assembly including a centrally bore tubular mandrel the exterior of which is provided with a downwardly facing annular support surface engageable with said upwardly facing shoulder of said bell nipple flange member to support said assembly, a lower tubular extension attached to said mandrel and extending into said blowout preventer stack and an upper tubular extension attached to said mandrel and extending upwardly through said bell nipple tubular member, said mandrel being supported within said bell nipple flange in a non-sealing manner in that fluid communication is established between the interiors of said upper and lower tubular extensions through the bore of said mandrel and fluid communication is established between annular spaces surrounding said upper and lower tubular extensions through at least one passageways through the body of said mandrel.

17. The apparatus of claim 16 including at least two of said passageways the angular displacement of the axes of which, as viewed in cross-section relative to the axis of said mandrel, is different than the angular displacement between said pin members so that is one of said passageways were aligned with one of said pin members the other of said passageways would not be aligned with any of said pin members.

18. The apparatus of claim 16 in which said blowout preventer stack includes an annular blowout preventer through which said lower tubular extension projects, said lower tubular extension being sealingly engageable by said annular blowout preventer, on actuation of said annular blowout preventer, isolating the exterior of said mandrel and said annular spaces surrounding said upper and lower extensions from fluid pressures within said well.

19. The apparatus of claim 16 in which said bell nipple flange member is provided with a plurality of radially disposed pin members radially movable between first positions not penetrating said central bore and second positions penetrating into said central bore for engagement with a locking shoulder provided on the exterior of said mandrel to lock said lubricator assembly within said bell nipple assembly.

20. The apparatus of claim 19 in which said pin members threadedly engage threaded radial holes provided in said bell nipple flange member, the outer ends of said pin members being engageable externally of said flange member for rotation thereof to effect said radial movement of said pin members between said first and second positions.

21. The apparatus of claim 20 in which said pin members are provided with indicia visible from the outer periphery of said flange member and by which it can be determined when said pin members are fully extended for engagement with said mandrel locking shoulder.

22. The apparatus of claim 21 in which said pin members are provided, at a specified distance from the inner ends thereof, with transverse hole through which a safety pin may project preventing said pin members from being moved to positions penetrating said central bore.

* * * * *